United States Patent [19]

Mellen

[11] 4,265,559

[45] * May 5, 1981

[54] ASPHALT SPREADING MACHINE

[76] Inventor: Craig R. Mellen, 4248 S. 900 East, Salt Lake City, Utah 84117

[ * ] Notice: The portion of the term of this patent subsequent to Aug. 21, 1996, has been disclaimed.

[21] Appl. No.: 37,895

[22] Filed: May 10, 1979

Related U.S. Application Data

[63] Continuation-in-part of Ser. No. 644,976, Dec. 29, 1975, Pat. No. 4,165,192.

[51] Int. Cl.[3] ..... A46B 17/02

[52] U.S. Cl. ..... 401/48; 401/137

[58] Field of Search ..... 401/5, 22, 25, 27, 48, 401/137, 138, 139, 265, 266

[56] References Cited

U.S. PATENT DOCUMENTS

| | | | |
|---|---|---|---|
| 2,824,442 | 2/1958 | Ames | 401/48 X |
| 3,087,188 | 4/1963 | Garlock | 401/48 |
| 3,343,202 | 9/1967 | Ames | 401/48 |
| 3,535,822 | 10/1970 | Fruth et al. | 401/48 X |
| 4,053,108 | 10/1977 | Hofmann | 401/48 X |
| 4,165,192 | 8/1979 | Mellen | 401/48 |

*Primary Examiner*—Edward M. Coven

*Attorney, Agent, or Firm*—Trask & Britt

[57] ABSTRACT

A vessel mounted for travel on a wheeled axle is adapted to feed hot liquid asphalt through a manifold to an application zone of a roof. The manifold rides on skids which fix its orientation with respect to horizontal. Special devices are mounted to follow the manifold across the application zone to first spread the liquid asphalt across the zone and to then gather and meter the spread asphalt leaving a predetermined quantity per unit area on the roof surface.

9 Claims, 5 Drawing Figures

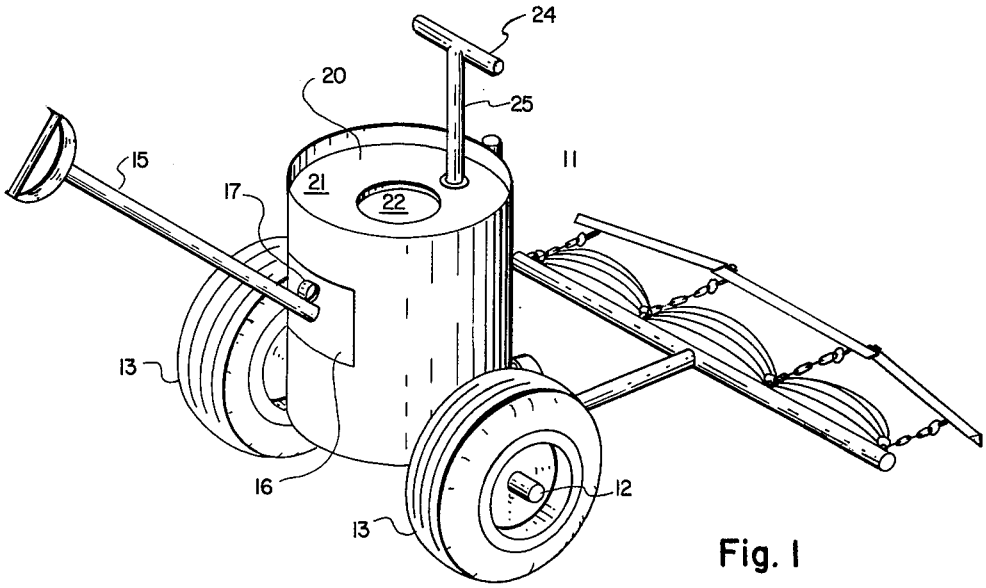
Fig. 1
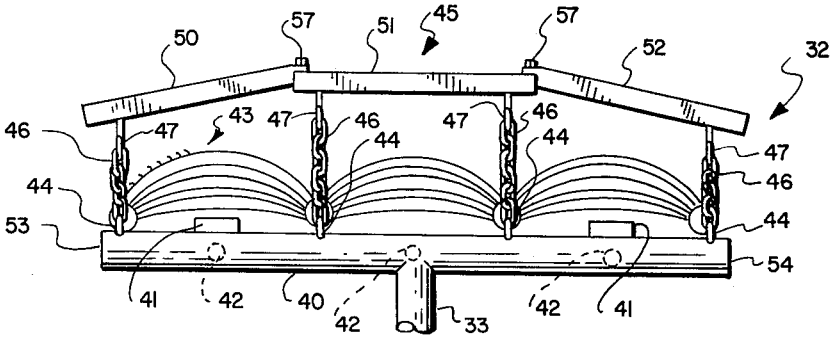
Fig. 2
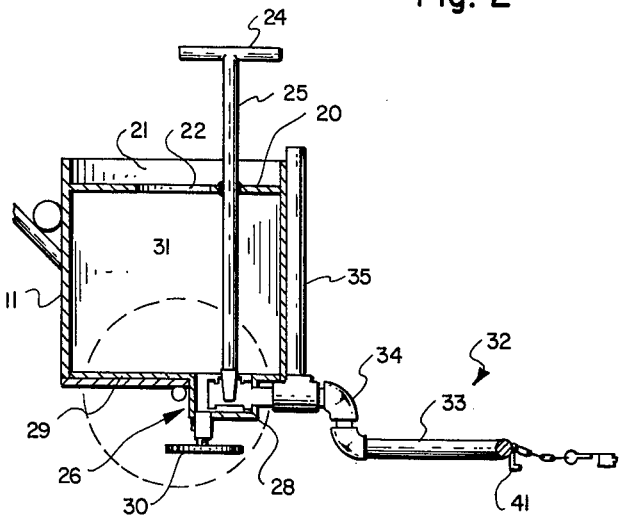
Fig. 3
Fig. 4
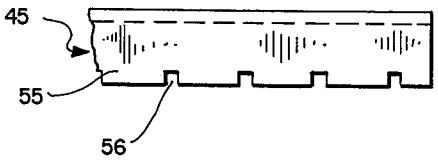
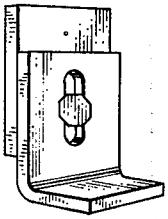
Fig. 5

ASPHALT SPREADING MACHINE

RELATED APPLICATIONS

This application is a continuation-in-part of commonly owned U.S. patent application Ser. No. 644,976, filed Dec. 29, 1975, now U.S. Pat. No. 4,165,192. The parent application describes and claims an asphalt spreading machine in which a vessel is mounted atop an axle journaled in and supported by wheels. The vessel is adapted to feed liquid asphalt through an arrangement of pipes onto a section of roof. The present application is directed to an asphalt spreading machine of similar type but with substantial improvements in the arrangement and function of component parts.

BACKGROUND OF THE INVENTION

1. Field

This invention relates to roofing construction and is specifically directed towards the application of hot asphalt compositions to roofs. It provides an apparatus especially adapted to apply hot asphalt uniformly in a selected quantity per unit area to a roof surface.

2. State of the Art

It is conventional practice to apply various roofing compositions in heated liquid form to roof surfaces. These compositions may contain tar, pitch and various asphaltic and/or bituminous components and are commonly referred to as "hot stuff" or "asphalt". The application of hot liquid asphalt to roof surfaces is a time consuming and labor intensive process. It is typically necessary to transfer materials from a source (such as a kettle), usually located on the ground, to an elevated position on the roof. It is not practical to transport more than limited quantities of the hot liquid material to an application zone on the roof because of the crude equipment available for this purpose, and the necessity for keeping the main portion of the material heated. Usual practice is to pour a quantity of hot asphalt onto the roof surface and then to spread it manually with mops and/or rakes. Hot material may be transferred from a kettle on the ground to the roof in a carrier, and then from the carrier to an application zone in a bucket. It is important that the asphalt material be spread uniformly, especially when it is used as a binder for rolled materials, such as roofing felt. Moreover, it is economically important that a sufficient, but not excessive, amount of asphalt material be applied to meet minimum specifications without undue waste. The techniques of the prior art have been inadequate from the standpoint of the efficient use of both labor and material.

Certain suggestions have been made concerning the applying and spreading of hot asphalt on a roof surface through the use of mechanical devices. An example of such a device is the chainlink roofing mop disclosed by U.S. Pat. No. 3,087,118. Although such devices should constitute a major improvement over the simple mops and rakes conventionally employed for this purpose, they nevertheless have been incapable of providing a well-metered, even distribution of "hot stuff" to a roof surface. Other liquid materials, such as waxes, have been applied to floor surfaces by means of mechanical applicators, such as the wax applicator disclosed by U.S. Pat. No. 2,877,476. Such devices are not well suited for the handling of hot liquid asphalt materials, however.

SUMMARY OF THE INVENTION

The present invention provides an asphalt spreading machine which combines the features of an asphalt carrier with those of an asphalt spreader thereby effecting substantial savings in asphalt transfer time and labor. The "carrier" of this invention constitutes a large capacity vessel, conveniently carrying in excess of fifteen gallons of hot liquid asphalt composition, mounted atop an axle which is journaled in and supported by spaced wheels. The vessel is thus conveniently dragged across an application zone of a roof by means of a handle associated with either the axle or the vessel itself. The vessel is desirably partially closed at its top to avoid splashing and spilling of material contained therein, but it is provided with suitable access at its top for the introduction of liquid asphalt. Ideally, a catch basin or open reservoir is located at the top of the vessel to serve as a funneling means to receive liquid asphalt and funnel it into the vessel through the partially closed top.

A suitable discharge means is located near the bottom of the vessel to accommodate the drainage of asphalt from the vessel onto the roof through special application means. The discharge means is desirably operable from outside the vessel (preferably at its top) to regulate the flow of liquid asphalt out from the bottom of the vessel at a selected rate. Ideally, the regulation of flow is through a valve, and the valve is desirably located in a well beneath the vessel to facilitate drainage. The valve is connected to a supply conduit which is in turn connected to feed a manifold mounted opposite the handle to trail the vessel approximately parallel the axle. The manifold extends transverse the width of the application zone. (The "application zone" as referred to throughout this disclosure is any portion of a roof to which asphalt is applied by a single machine of this invention during a single pass in a straight "longitudinal" direction of travel.) The manifold, which is usually a conduit or pipe, is provided with a series of holes, slots or other suitable ports to permit the flow of liquid asphalt from the manifold in a series of streams onto the roof surface.

The manifold is held spaced from the roof surface by skids. The skids are desirably independently adjustable so that the manifold may be held level with respect to horizontal even though the application zone may be sloped with respect to horizontal due to the pitch of the roof. In this fashion, the influence of gravity on asphalt flow can be obviated.

According to a highly preferred embodiment of this invention, the wheel base of the axle is narrower than the width of the application zone (the length of the manifold). By this means it is possible to flood coat an entire roof without ever running the wheels of the asphalt spreader of this invention through previously applied asphalt. In a typical procedure, the apparatus of this invention is dragged across an application zone until the asphalt is exhausted from the vessel or the width of the roof is traversed. The spreader is then returned across the roof for a new load of asphalt and is returned in the same direction of travel as was followed during the first application to coat a second adjacent application zone. In this way, the skids need only be adjusted once to maintain a proper horizontal orientation of the manifold. Asphalt is almost always dropped in a single direction of travel in any event, because rolled material is applied to overlap, making it impractical to apply the asphalt in the reverse direction. That is, the second application zone will inevitably overlap the first application zone. It may in some instances be desirable to reverse the slope of the manifold so that the hydrostatic head of the asphalt within the manifold causes somewhat more material to be deposited on the uphill portion of the application zone, thereby compensating for the natural downhill flow of asphalt on the roof.

An important aspect of this invention is the fashion in which the asphalt is spread and metered subsequent to discharge from the manifold. As the vessel is dragged across the application zone of the roof, asphalt discharged from the manifold to the roof is first contacted by means dragged behind the manifold into the freshly deposited asphalt. These means may be screens of the type disclosed by the aforementioned parent application, the the disclosure of which is incorporated herein by reference. Ideally, a series of teasing chains is associated with each discharge port. A separate set of chains is dragged across each stream of asphalt, thereby urging it to flow outward to merge with adjacent streams. Eventually, the merged streams spread across substantially the entire width of the application zone. A rake is dragged behind the teasing chains to gather the hot asphalt material into a pool transverse the zone. Metering grooves in the rake pass the pooled material to effect a plurality of approximately parallel longitudinal beads or ribbons. The beads tend to flow together into an even coat. Rakes with various groove characteristics may be interchangeably provided to correlate with the flow characteristics of specific asphalt compositions and selected spreading rates. In this fashion, by selecting appropriate rakes, a predetermined number of pounds per unit area of asphalt of any viscosity may be reliably and evenly applied throughout the zone.

BRIEF DESCRIPTION OF THE DRAWINGS

In the drawings, which illustrate what is presently regarded as the best mode for carrying out the invention:

FIG. 1 is a pictorial representation of a preferred form of the apparatus of this invention;

FIG. 2 is a plan view of the application portion of the apparatus of FIG. 1;

FIG. 3 is a view in section showing certain internal components of the apparatus of FIG. 1;

FIG. 4 is a fragmentary view of a rake portion of the apparatus; and

FIG. 5 is a view of an adjustable skid.

DESCRIPTION OF THE ILLUSTRATED EMBODIMENT

Referring first to FIG. 1, a large capacity metal vessel 11 is mounted atop an axle 12 journaled within and supported by a pair of spaced wheels 13. A handle 15 extends from attachment to a support plate 16 on one side wall of the vessel 11. As shown, the handle 15 is welded to the plate 16 and the welded connection is strengthened by a metal ring 17 welded between the handle 15 and plate 16.

For purposes of this disclosure, the top of the vessel 11 is regarded as being defined by a recessed plate 20 fixed in place to partially close the vessel 11. The plate 20 also defines the bottom of an open reservoir 21 which communicates with the vessel 11 through an opening 22 at the center of the plate 20. A handle 24, operable from above the vessel 11, is connected to rotate a shaft 25 journaled through the plate 20 to operate a valve 26 (FIG. 3). The valve 26 is shown mounted within a housing 28 beneath the bottom plate 29 of the vessel 11. It is preferred that the valve 26 be constructed of a material with relatively low heat capacity; e.g., brass, so that it will rapidly rise in temperature upon contact with hot asphalt composition. In this way, freezing of the asphalt when it is poured into a cool vessel is avoided. As shown, the valve is of the pitcock type, although other valving arrangements are operable. Ideally, the valve is provided with a drain plug 30 as shown. With the valve 26 opened or partially opened, liquid asphalt flows from the interior 31 of vessel 11 through an application system, designated generally 32, which includes a supply conduit 33 and connective piping 34. As shown, the supply conduit 33 is vented through a stand pipe 35 to the atmosphere, even when the valve 26 is closed.

As best illustrated by FIG. 2, the supply conduit 33 is connected to a manifold 40 which rides on a spaced pair of skids (or skates) 41. Asphalt is discharged from the bottom of the manifold 40 through a plurality of ports 42. A set of teaser chains 43 is attached to drag behind the manifold 40 behind each of the ports 42, thereby spreading the asphalt deposited from each port 42. As shown, each set of teaser chains 43 includes a plurality of differing lengths of chain anchored in common at their respective ends to eyebolts 44 fixed to the manifold 40. A rake, designated generally 45, is dragged behind the chains 46, each of which is connected by one end link to the eyebolts 44 and at their opposite ends to eyebolts 47 connected to the rake 45.

The rake 45 illustrated comprises three segments 50, 51, 52. The central segment 51 is dragged approximately parallel and directly behind the middle segment of the manifold 40. It is so arranged as to gather asphalt deposited from the central port 42 and spread by the central group of teasing chains 43. The adjacent segments 50 and 52, respectively, are angeled slightly from the central segment 51 back to converge towards the distal ends 53, 54, respectively, of the manifold 40. Although the central segment 51 of the rake 45, as viewed in plan (FIG. 2), is approximately parallel the manifold 40, the rake is loosely connected by the chains 46 to maintain substantial contact with the roof surface of the application zone. As previously noted, the manifold 40 may be held by skids 41 at an attitude substantially nonparallel with the roof surface. Accordingly, the relative orientations of the manifold 40, chains 43 and rake 45, as described herein, assume a plan view perspective. In any event, the rake 45 includes a scraper blade portion 55 which is provided with a plurality of grooves 56, as best seen by FIG. 4. These grooves 56 permit passage of approximately parallel beads of asphalt through the rake 45 as it is dragged across the gathered asphalt material. The size and spacing of the grooves 56 may be selected with due consideration for the temperature, the ambient conditions and viscosity characteristics of the particular composition being applied. Individual rake segments 50, 51, 52 may be interchanged by being disconnected at the couplings 57 (FIG. 2) and eyebolts 47. More commonly, the entire rake 45 will be interchanged to provide the desired arrangement of grooves 56 for a particular application.

Reference herein to details of the illustrated embodiment should not be taken as limiting the scope of the appended claims, which themselves recite those details regarded as essential to the invention.

I claim:

1. Apparatus for carrying and applying hot roofing asphalt compositions comprising:

a vessel mounted to an axle journaled in and supported by a pair of wheels constituting means for carrying a quantity of liquid asphalt from a source to application zones of a roof;

handle means at one side of the vessel for pulling said vessel to cause it to travel on said axle across an application zone;

filling means at the top of said vessel including an open reservoir with a bottom plate constituting the top of said vessel, including an opening to permit flow of liquid asphalt from said reservoir into said vessel;

discharge means at the bottom of said vessel operable to regulate the flow of liquid asphalt out from the bottom of said vessel at a selected rate; and application means fixed to said vessel to receive liquid asphalt from said discharge means and adapted to spread said asphalt uniformly within said application zone, including:

a supply conduit extending from said discharge means generally away from said handle, a manifold mounted to follow said axle and connected to receive asphalt from said supply conduit, skid means associated with said manifold to bear upon the roof when the vessel is pulled across an application zone; thereby fixing the slope of said manifold with respect to horizontal, discharge ports in said manifold, constituting means for depositing spaced streams of liquid asphalt on the roof within said application zone, spreading means mounted to follow said manifold as the vessel is pulled, thereby to spread said streams of asphalt across the width of the said application zone; and rake means mounted to follow said spreading means and adapted to form said spread asphalt into a plurality of approximately parallel ridges, thereby to meter a predetermined quantity of asphalt per unit area applied to said application zone.

2. Apparatus according to claim 1 further including vent means associated with said application means to vent said supply conduit and manifold to the atmosphere when flow of asphalt from the vessel is stopped.

3. Apparatus according to claim 1 wherein said discharge means includes valve means of relatively lower heat capacity material than the vessel located for physical contact by liquid asphalt introduced to said vessel.

4. Apparatus according to claim 3 wherein said discharge means includes a chamber beneath said vessel and said chamber houses said valve means.

5. Apparatus according to claim 4 wherein said valve means is operated from a location at the top of said vessel.

6. Apparatus according to claim 1 wherein said spreading means comprises teasing chains.

7. Apparatus according to claim 1 wherein said skid means are adjustable so that the manifold may be held level with horizontal when the axle is parallel with the slope of the roof.

8. Apparatus according to claim 1 wherein said rake means comprises a scraper blade adapted to gather the spread asphalt along its leading edge with a plurality of openings adapted to pass ribbons of asphalt therethrough.

9. Apparatus according to claim 8 wherein said scraper blade is segmented into a central section approximately parallel the manifold and a pair of end sections extending from said central section in converging relation with opposite ends of said manifold.

* * * * *